United States Patent [19]

Goldberger

[11] 4,409,073

[45] Oct. 11, 1983

[54] PROCESS FOR THE ELECTROLYTIC REDUCTION OF METALS AND AN IMPROVED PARTICULATE CARBON ELECTRODE FOR THE SAME

[75] Inventor: William M. Goldberger, Columbus, Ohio

[73] Assignee: Superior Graphite Co.

[21] Appl. No.: 164,803

[22] Filed: Jun. 30, 1980

[51] Int. Cl.[3] ..... C25C 3/06; C25C 3/12; C25C 7/02

[52] U.S. Cl. ..... 204/67; 204/243 R; 204/215; 204/284; 204/247

[58] Field of Search ..... 204/67, 243 R, 247, 204/64, 70, 245

[56] References Cited

U.S. PATENT DOCUMENTS

| | | | |
|---|---|---|---|
| 2,451,490 | 10/1948 | Johnson | 204/67 |
| 3,017,336 | 1/1962 | Olstowski | 204/64 R |
| 3,470,075 | 9/1969 | Johnson | 204/247 |
| 3,582,483 | 6/1971 | Sem | 204/243 R |

FOREIGN PATENT DOCUMENTS

| | | | |
|---|---|---|---|
| 309605 | 7/1930 | United Kingdom | 204/67 |
| 483068 | 7/1936 | United Kingdom | 204/70 |

*Primary Examiner*—Howard S. Williams
*Attorney, Agent, or Firm*—Robert M. Ward

[57] ABSTRACT

One aspect of the present invention concerns an improved process for the electrolytic reduction of a metal from a metal compound and comprises the steps of providing a carbon cathode within a container, dissolving the metal compound in a molten salt electrolyte solvent bath which is disposed within the container, the molten electrolyte bath having a higher decomposition potential than the metal compound and having a lesser density than the reduced molten metal, and continuously providing a particulate, free-flowing, high purity, and highly conductive carbon material to the molten bath to serve as the anode, the particulate carbon material having a lesser density than the molten bath, placing an electrical connection in contact with the particulate carbon anode material and applying an electric current thereto, and collecting reduced metal at the cathode.

In another aspect of the present invention, a high purity and highly conductive, free-flowing particulate carbon material having a density lower than that of an electrolytic bath and floating thereon is provided to form the cell anode and in preferred embodiments is continuously provided to the cell as the particulate carbonaceous anode material is consumed.

20 Claims, 1 Drawing Figure

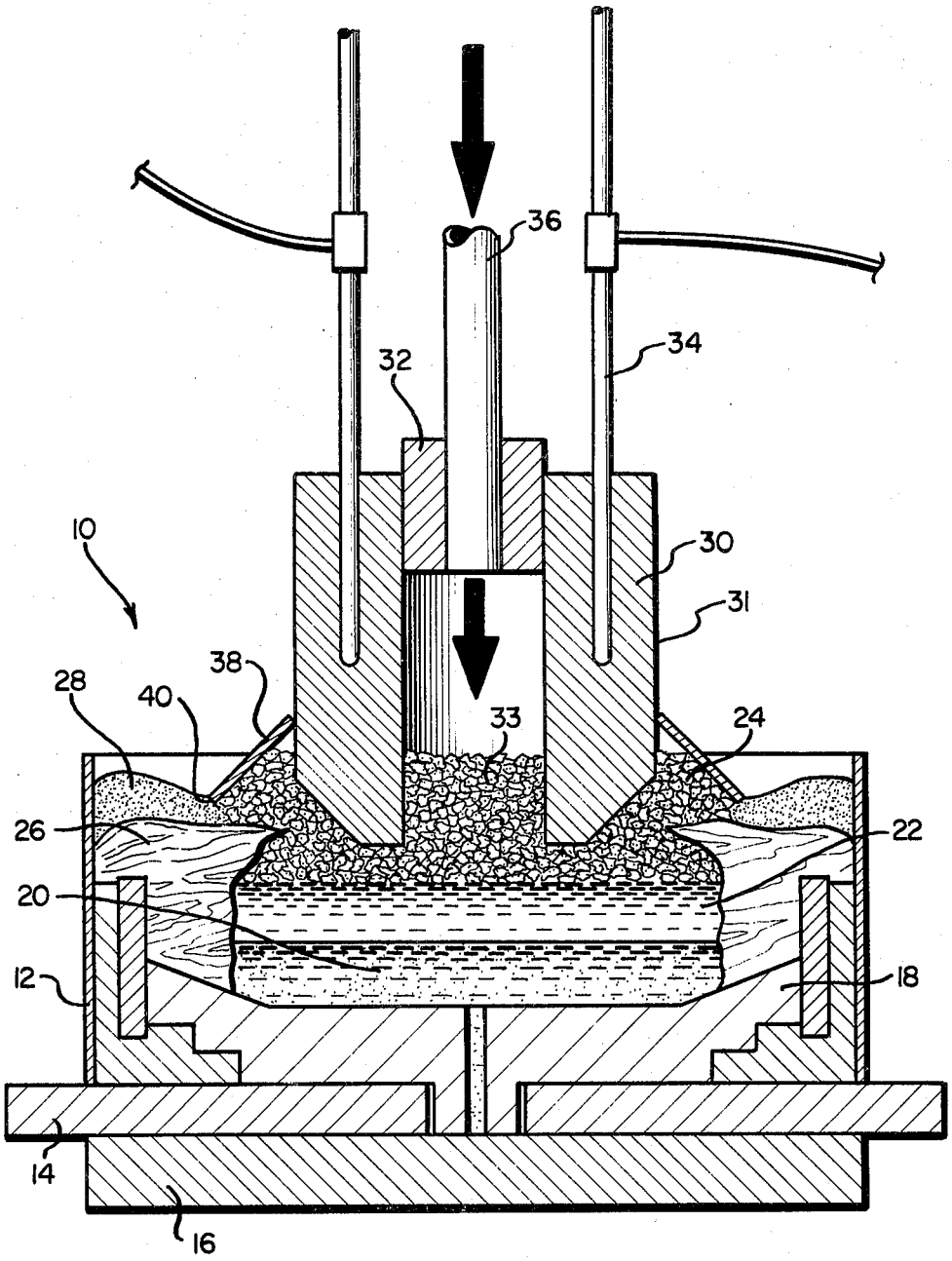
36
34
32
10
30
31
38
28
40
33
24
26
22
20
12
18
14
16

PROCESS FOR THE ELECTROLYTIC REDUCTION OF METALS AND AN IMPROVED PARTICULATE CARBON ELECTRODE FOR THE SAME

BACKGROUND OF THE INVENTION

The present invention relates generally to methods and apparatus for electrolytic reduction of metal and more particularly to improved methods and apparatus for the continuous provision of a high purity and highly conductive, particulate, free-flowing carbon material to serve as the anode of the reduction cell.

In the prior art, metals are reduced from metallic compounds by means of the fused salt electrolysis cell. This technique is particularly applicable to the reduction of aluminum wherein alumina ($Al_2O_3$) is reduced to aluminum metal with the utilization of a carbon anode. The electro-chemical reaction which results in the formation of metallic aluminum yields oxygen at the anode. Oxygen in turn reacts with the anode carbon to form carbon dioxide. The overall electrolysis of alumina can be summarized by the simplified equation:

$$2Al_2O_3+3C \rightarrow 4Al+3CO_2$$

The theoretical carbon requirement based on this stoichiometry is 0.33 lbs. carbon/lb. aluminum. However, present industry practice requires approximately 0.5 lbs. carbon/lb. aluminum.

Expressed as a quantitative total, the usage of carbon anodes for aluminum production is approaching 5 million tons per year on a worldwide basis. This commercial process is however not without difficulty and improvement therein is indicated to lower costs. In particular, anode carbon is an expensive reagent for a chemical process. Anode carbon is in itself a product of manufacture that must meet close specifications. The carbon anodes which are typically used for this process must have suitable density, low sulfur content and grindability.

One method of producing carbon anodes is by prebaking of ground carbon. The manufacture of prebaked bulk carbon anodes is a complex series of operations involving mixing of calcined petroleum coke or anthracite with pitch materials and binders, extruding the mix into the desired shape, and then slow baking in a furnace at temperatures in excess of 1000° C. Alternatively, calcined petroleum coke or calcined anthracite can be mixed as a paste and baked in place as it is used in the electrolytic cell. This continuously formed electrode is known as the Soderberg-type electrode. However, the present trend, because of emission control and process control considerations, is to use the pre-baked carbon shapes.

Means to reduce the consumption of anode carbon during aluminum cell operation is a subject of continuing study by the aluminum producers. Anode loss is not due simply to chemical reaction. It has been found that the carbon residue from the pitch binder is more reactive with oxygen than are the coke particles of the electrode mix, and this selective oxidation of binder coke causes the anode to disintegrate at the working surface. Results of studies suggest that selective oxidation and disintegration is the principal reason for the substantially higher consumption of the anode than that corresponding to the formation of carbon dioxide by the presented chemical reaction.

One possible means to eliminate the consumption of the carbon anode is to use some other electrode material which is inert in use in the electrolysis cell. However, there are very limited possibilities of development of materials other than carbon and graphite that can withstand the highly corrosive molten cryolite, and liberated oxygen and fluorine. Moreover, such non-consumable anode materials must be compatible electrically and thermally with the Hall-Heroult cell requirements.

The ability to use a non-consumable anode is a major incentive for the current interest in development of the aluminum chloride electrolysis route to aluminum metal. In this process, the chloride rather than the oxide is electrolyzed to obtain metallic aluminum. In addition to a number of advantages claimed for the chloride process, graphite electrodes can be used with little consumption because chlorine liberated by the cell reaction is not nearly as reactive with the carbon as is oxygen. The chloride process, however, does require a purified aluminum chloride, which at present is being made by chlorination of alumina. The advantages gained at the electrolysis step are at the expense of the additional and complex processing of alumina into high purity aluminum chloride. Further improvement in electrolytic reduction techniques is indicated.

Anodes made of graphite can be used in the Hall-Heroult cell in place of the pre-baked or Soderberg-type carbon electrodes. Graphite is less reactive and, therefore, consumption of graphite anodes would be substantially lower than that of carbon. This potential advantage of graphite is offset by the fact that graphite is more costly to produce. Substantially higher furnace temperatures and longer baking times are required to manufacture graphite than to make carbon electrodes. Additionally, the lower electrical resistance and higher thermal conductivity of graphite electrodes results in higher heat loss through the electrode column, which leads to a higher rate of oxidation of the electrode at the top. Attempts have been made to incorporate particulate graphite as part of the carbon mix going into the manufacture of such anodes. It is found, however, that it is difficult to form the desired electrode shape using particulate graphite, and other economic factors have precluded the use of particulate graphite for this purpose.

Wherefore, in view of the shortcomings and deficiencies of the prior art, it is a primary objective of the method of the present invention to improve these methods of production of metals and especially aluminum metal by the electrolytic reduction of metallic compounds, such as for example alumina and/or the aluminum halides in alternative embodiments. The improved method and apparatus of the present invention are intended to reduce significantly the consumption of carbon per unit of aluminum produced. It is a further objective hereof to simplify the operation of the aluminum smelter by eliminating the need to periodically replace partially consumed pre-baked electrodes or to continuously produce within the smelter shop the paste electrodes of the Soderberg-type. Further objectives and advantages of the improved method and apparatus of the present invention will be evident from the following brief description of the drawing, detailed description of preferred embodiments and appended claims.

SUMMARY OF THE INVENTION

In one aspect of the present invention, an improved process for the electrolytic reduction of a metal from a metal compound is set forth and comprises the steps of providing a preferably saucer-shaped carbon cathode within a container, dissolving the metal compound in a molten salt electrolyte solvent bath disposed within the container, the molten electrolyte bath having a higher decomposition potential than the metal compound and having a lesser density than the reduced molten metal, and continuously providing a particulate, free-flowing, high purity and highly conductive carbon anode material to the molten bath, with the particulate carbon material having a lesser density than the molten bath, placing an electrical connection in contact with the particulate carbon material and applying an electric current thereto, and collecting a reduced metal at the preferably saucer-shaped cathode.

In another aspect of the present invention, a high purity and highly conductive, free-flowing particulate carbon material having a density lower than that of an electrolytic bath and floating thereon is provided to form the cell anode, and in preferred embodiments is continuously provided to the cell as the particulate carbon anode material is consumed.

The improved process for the electrolytic reduction of metals and an improved particulate carbon anode of the present invention, and preferred and alternative embodiments thereof, may be more completely understood with reference to the following drawing and the detailed description of exemplary embodiments.

BRIEF DESCRIPTION OF THE DRAWING

An exemplary embodiment of an apparatus for carrying out the improved method for electrolytic reduction of a metal from a metallic compound of the present invention is illustrated in the following drawing, in which:

FIG. 1 is a longitudinal cross-sectional view of an electrolytic cell for the production of reduced metal, such as aluminum, and includes a carbon cathode in contact with an insulated electrical terminal, a molten salt electrolyte solvent bath having the metallic compound to be reduced dissolved therein, particulate carbon anode material floating on the electrolytic bath, electrical connection means in contact with the particulate carbon anode material, means for the continuous introduction of such particulate carbon anode material, means for trapping and collecting gas generated at the cell anode, and reduced metal collected at the cathode.

DETAILED DESCRIPTION OF PREFERRED EMBODIMENTS

The improved process for the electrolytic reduction of a metal from a metallic compound comprises in preferred embodiments the first step of providing a carbon cathode within a container. The carbon cathode is preferably saucer-shaped for collection of the reduced metal and is disposed in preferred embodiments near the bottom of the container. A metallic compound is dissolved in a molten salt electrolyte solvent bath which is disposed within the container and in contact with the cathode. The molten electrolyte has a higher decomposition potential than the metallic compound to be reduced and also has a lesser density than the reduced molten metal. A particulate, free-flowing, high purity and highly conductive carbon material is preferably continuously provided and preferably near or at the surface of the molten electrolyte bath and has a lesser density than the bath to float thereon. An electrical connection is placed in contact with the particulate carbon anode material and electrical current is supplied thereto, whereby reduced metal is formed and collected at the cathode.

In preferred embodiments the reduced metal may be aluminum and the metallic compound may be alumina. In such preferred embodiments, the molten electrolyte preferably comprises cryolite ($Na_3AlF_6$). In alternative embodiments, the metallic compound may comprise an aluminum halide, in which case the molten electrolyte is selected from the group consisting of alkali metal halides and alkaline earth halides. In further preferred embodiments, the gas which is produced at the anode may be collected and vented. In all these preferred embodiments, the particulate carbon material may be preferably formed from desulfurized petroleum coke which may be partially graphitized.

Another aspect of the present invention is directed to an improved anode apparatus for use in an electrolytic cell for the electrolytic reduction of a metal from a metal compound. Such a cell preferably includes a carbon cathode disposed in contact with a molten salt electrolytic bath in which the metal compound to be reduced is dissolved. The improved anode apparatus of the present invention comprises a high purity and highly conductive, free-flowing, particulate carbon material having a density lower than the electrolytic bath and floating thereon to comprise the cell anode. Electrical connector means are disposed in contact with the free-flowing particulate carbon material to provide electrical current thereto. Preferably, means are included for continuously providing the free-flowing particulate carbon anode material to the cell. These means may preferably comprise a tubular electrode housing having a central aperture therein for containing a head of the free-flowing particulate carbon anode material for gravity feeding the same to float on the molten salt electrolytic bath as the particulate carbon anode material is consumed.

Gas collecting means may be further provided for collecting and evacuating gases formed at the particulate carbon anode. Such gas collecting means may preferably comprise a truncated conical skirt having a bottom edge and a top edge, with the top edge sealingly disposed on the electrode housing for preventing leakage of the gas therebetween. The bottom edge is disposed downwardly and into the particulate carbon anode electrode material for collecting the gas generated thereby.

In such embodiments, the carbon cathode may preferably comprise a saucer-shaped plate disposed beneath the molten salt electrolyte bath, and such carbon cathode plate preferably rests on a cathode collector bar and is insulated at the bottom thereof.

The particulate carbon anode material utilized may in preferred embodiments be a partially graphitized carbon which is preferably prepared from petroleum coke.

Also in preferred embodiments, there may be provided solid electrolyte bath material which is sealingly disposed between the conical skirt bottom edge and the cathode for funneling the generated gases upwardly to be confined by the skirt. Additionally, a portion of the metal compound may be disposed over and substantially covering the solid electrolyte material.

Referring to FIG. 1 of the drawing, wherein an electrolytic cell generally 10 for the electrolytic reduction of a metal, such as aluminum metal from a metal compound such as alumina or aluminum halides, is shown, cell 10 comprises a container 12 having a cathode collector bar 14 disposed at the bottom thereof. The cathode collector bar 14 is insulated at the bottom surface thereof with insulation 16. Disposed oppositely from insulation 16 and on the upper surface of cathode collector bar 14 is a carbon cathode 18, which is preferably saucer-shaped to accommodate a pool of reduced molten aluminum 20 therein. Floating on top of the molten aluminum 20 is a lower density electrolyte bath 22 and floating on bath 22 are carbon anode particles 24. At the periphery of molten bath 22, and where the temperatures are lower, the electrolyte bath 22 is in a frozen condition, as shown at 26, and may be covered with a covering 28 of the frozen material 26 of the aluminum compound which has also been dissolved in the molten electrolyte bath 22. Means for continuously supplying particulate carbon anode material, such as an electrode housing 30, are provided, with electrode housing 30 having a central aperture 32 therein for supplying a head 33 of the carbon anode particulate material. The electrode housing 30 is provided with an electrical terminal 34 for supplying electrical current thereto. Central aperture 32 may be supplied through a particulate carbon feeder tube 36. Also, electrode housing 30 may be supplied with a gas collecting skirt 38 which is preferably a truncated cone in shape and is sealingly connected to the electrode housing 30. The lower peripheral edges 40 of skirt 38 are embedded in and covered by the metallic compound covering 28 disposed over the frozen electrolyte 26, whereby gases generated by carbon particulate anode material 24 are trapped beneath skirt 38 for collection and venting.

As shown in FIG. 1, the apparatus and methods of the present invention use particles of carbon, rather than bulk-fabricated shapes of carbon as the anode of material. The particular carbon particles which are usable in the method of the present invention must have suitable chemical and physical characteristics to provide the needed operating requirements of this fused salt electrolysis process. More specifically, the particulate carbon must be of high purity and essentially free of volatile hydrocarbons, sulfur and metallic impurities such as iron, silicon, titanium, vanadium, and nickel. Yet further, for the purpose of conducting the improved methods of electrolysis of the present invention, the particles of carbon must flow freely in the dry state. This free-flowing particulate carbon can be introduced into the electrolysis cell as needed to maintain a steady state electro-chemical reaction condition.

Carbon block is used as the material for cathode 18. Carbon or preferably graphite is used as the material for electrode housing 30, through which particulate carbon 24 is feed into cell 10. The housing may preferably be partially encased in a steel covering 31. The particulate carbon 24 is fed through electrode housing 30 on demand. The elevation of head 33 of particulate carbon 24 maintained within electrode housing 30 can be monitored by various known automatic measuring devices (not shown) and used to automatically control the feed of particulate carbon 24 through electrode housing 30.

The characteristics of particulate carbon 24 to be used by the method described are extremely important to the successful performance of the electrolysis cell. The particulate material should have low electrical resistivity to minimize the internal energy losses within the current carrying circuit. The particulate material should also have a relatively low thermal conductivity to minimize heat losses through the column of particulate and the electrode housing. Of critical importance also is the density of particulate carbon 24. The density of aluminum metal varies between 2.25 and 2.28 within the range of electrolysis cell operating temperatures. Molten cryolite, which in preferred embodiments serves as the molten electrolyte bath 22, ranges in density from about 1.98 to 2.09 in the same temperature range. It is mandatory that the particulate carbon material be lower in density than the cryolite bath 22 to maintain sufficient buoyancy to float thereon and to effectively surround and shield the bottom surfaces of electrode housing 30 as indicated in the drawing of FIG. 1. It is important also that the particulate carbon be relatively non-reactive with oxygen within the operating conditions of the cell.

The use of particulate desulfurized petroleum coke sold under the trademark "DESULCO" by the Superior Graphite Co., Chicago, Illinois, is especially well suited for this purpose. The "DESULCO" material is thermally purified and contains generally less than about 0.02% sulfur, no volatile hydrocarbons and only trace amounts of metallic elements. It is substantially more electrically conductive than petroleum coke. Of key importance, the "DESULCO" material oxidizes only very slowly in comparison with petroleum coke or baked carbon. The particle density of "DESULCO" carbon is generally about 1.5 grams/cc. This provides adequate difference in density to maintain a buoyant layer of "DESULCO" on the upper surface of molten cryolite. This particulate carbonaceous material may be preferably made according to the methods of U.S. Pat. No. 4,160,813.

The basic and novel characteristics of the improved process for the electrolytic reduction of metals and the improved particulate carbon anode of the present invention will be readily understood from the foregoing disclosure by those skilled in the art. It will become readily apparent that various changes and modifications may be made in the form, construction and arrangement of the improved process for the electrolytic reduction of metals and the improved particulate carbon anode of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. An improved process for the electrolytic reduction of molten aluminum from an aluminum compound comprising the steps of:

providing a carbon cathode within a container;

dissolving the aluminum compound in a molten salt electrolyte solvent bath disposed within the container and in electrical contact with the cathode, said molten electrolyte having a higher decomposition potential than the aluminum compound, said molten bath having a lesser density than the reduced molten aluminum;

continuously providing a high purity and highly conductive, particulate, free-flowing, low density carbon material to said molten bath to serve as the anode, said carbon material having a lesser density than the molten bath to float thereon;

placing an electrical connection in contact with the particulate carbon anode;

applying electrical current thereto and collecting reduced molten aluminum at the cathode to form a pool; and draining accumulated reduced molten aluminum from the pool thereof.

2. An improved process of claim 1 for the electrolytic reduction of molten aluminum from an aluminum compound wherein the aluminum compound comprises alumina.

3. An improved process of claim 2 for the electrolytic reduction of molten aluminum from an aluminum compound wherein the molten electrolyte comprises cryolite.

4. An improved process of claim 1 for the electrolytic reduction of molten aluminum from an aluminum compound further comprising collecting and venting the gas produced at the anode.

5. An improved process of claim 4 for the electrolytic reduction of molten aluminum from an aluminum compound wherein the molten electrolyte is selected from the group consisting of alkali metal halides and alkaline earth halides.

6. An improved process of claim 1 for the electrolytic reduction of molten aluminum from an aluminum compound further comprising collecting and venting the gas produced at the anode.

7. An improved process of claim 1 for the electrolytic reduction of molten aluminum from an aluminum compound wherein the particulate carbon anode material is an at least partially graphitized material.

8. An improved process for the electrolytic reduction of molten aluminum from an aluminum compound of claim 1 wherein the low density carbon material that is continuously provided has a density in the range of about 1.5 grams/cc. and less than about 1.98 grams/cc.

9. In an electrolytic cell for the electrolytic reduction of molten aluminum from an aluminum compound, said cell including a carbon cathode adapted for disposition in electrical contact with a molten salt electrolytic bath in which the aluminum compound is dissolved, the improvement comprising:

a high purity and highly conductive, free-flowing particulate carbon material having a density lower than the electrolytic bath and adapted to float thereon to comprise the cell anode; and electrical connection means disposed in contact with said free-flowing particulate carbon anode material for providing current thereto.

10. The electrolytic cell of claim 9 for the electrolytic reduction of molten aluminum from an aluminum compound further comprising continuous means for providing said free-flowing particulate carbon anode material to the cell.

11. The electrolytic cell of claim 10 for the electrolytic reduction of molten aluminum from an aluminum compound wherein said continuous means comprise a tubular electrode housing having a central aperture therein for containing a head of said free-flowing particulate carbon anode material for gravity feeding the same to float on the molten salt electrolyte bath as said particulate carbon anode material is consumed.

12. The electrolytic cell of claim 11 for the electrolytic reduction of molten aluminum from an aluminum compound wherein said electrical connection means is connected to said tubular electrode housing.

13. The electrolytic cell of claim 12 for the electrolytic reduction of molten aluminum from an aluminum compound further comprising a gas collcting means for collecting and evacuating gases formed at said particulate anode.

14. The electrolytic cell of claim 13 for the electrolytic reduction of molten aluminum from an aluminum compound wherein said gas collecting means comprise a truncated conical skirt having a bottom edge and a top edge, said top edge adapted for sealing disposition on said electrode housing for preventing leakage of the gas therebetween, and said bottom edge is disposed in said particulate carbon anode material for collecting the gas generated thereby.

15. The electrolytic cell of claim 14 for the electrolytic reduction of molten aluminum from an aluminum compound wherein the solid electrolyte bath material is sealingly disposed between said conical skirt bottomm edge and said cathode for funneling the generated gases upwardly to be confined by said skirt.

16. The electrolytic cell of claim 15 for the electrolytic reduction of molten aluminum from an aluminum compound wherein a portion of the aluminum compound is disposed over and substantially covers said solid electrolyte material.

17. The electrolytic cell of claim 9 for the electrolytic reduction of molten aluminum from an aluminum compound wherein the carbon cathode comprises a generally saucer-shaped plate adapted for supportive disposition beneath the molten aluminum reduced thereon.

18. The electrolytic cell of claim 17 for the electrolytic reduction of molten aluminum from an aluminum compound further comprising a cathode collector bar disposed beneath said carbon cathode plate and insulated at the bottom surface thereof.

19. The electrolytic cell of claim 9 for the electrolytic reduction of molten aluminum from an aluminum compound wherein said particulate carbon anode material is at least partially graphitized.

20. The electrolytic cell of claim 9 for the electrolytic reduction of molten aluminum from an aluminum compound wherein said particulate carbon anode material is prepared from petroleum coke.

* * * * *